US006835170B2

(12) United States Patent
Ogle

(10) Patent No.: US 6,835,170 B2
(45) Date of Patent: Dec. 28, 2004

(54) LOW BACK STRETCHING SLEEPER

(76) Inventor: Henry Francis Ogle, 1805 Hosmer La., Crest Hill, IL (US) 60435

( * ) Notice: Subject to any disclaimer, the term of this patent is extended or adjusted under 35 U.S.C. 154(b) by 0 days.

(21) Appl. No.: 09/778,503

(22) Filed: Feb. 7, 2001

(65) Prior Publication Data

US 2002/0147085 A1 Oct. 10, 2002

(51) Int. Cl.[7] ..... A63B 26/00

(52) U.S. Cl. ..... 482/142; 482/907; 482/908; 482/140; 482/24; 482/145; 297/423.1; 601/56

(58) Field of Search ..... 482/140, 91, 907, 482/908, 145, 24, 95, 96; 606/240–242; 601/56; 297/423.1

(56) References Cited

U.S. PATENT DOCUMENTS 6,203,473 B1 * 3/2001 Atwood ..... 482/95

* cited by examiner

*Primary Examiner*—Nicholas D. Lucchesi
*Assistant Examiner*—L Amerson

(57) ABSTRACT

A low back stretching exercise apparatus which positions the user's knees into a zero to eighty-nine degree angle facing over their head thereby assuring the creation of a safe and gentle longitudinal-convex stretching of the muscles of the human low back. This specific longitudinal-convex stretching action improves low back strength and flexibility and helps to relieve muscle discomfort cause by abnormal stresses on the low back muscles. The unit is height adjusted using the Upright supports (12) & (16) and Tilt brackets (24). The person lies supine between the Stabilizer extensions (20) and places their calves on top of the Deck (10). The angle is adjusted by coupling the Connecting rods (14) with the Angle control bars (22).

2 Claims, 2 Drawing Sheets

LOW BACK STRETCHING SLEEPER

CROSS-REFERENCE TO RELATED APPLICATIONS

"Not Applicable"

STATEMENT REGARDING FEDERALLY SPONSORED RESEARCH OR DEVELOPMENT.

"Not Applicable"

REFERENCE TO A MICROFICHE APPENDIX

"Not Applicable"

BACKGROUND OF THE INVENTION

Background

1. Field of Endeavor

This invention relates to low back exercise equipment to properly and safely stretch the human low back muscles

BACKGROUND

2. The Problem

Low back muscle related problems such as low back weakness, the low back 'broken hinge' effect, and general low back soreness, numbness, and pain are rampant among the human population. Many theories of low back exercises and exercise equipment have been proposed, developed, and implemented but the problem has not decreased, in fact, it has become almost epidemic. Experts estimate that over 80% of the American population will suffer with significant low back related problems sometime during their lifetime. Experts estimate that, on any given morning, over six million Americans can barely get out of bed due to low back muscle pain. Many of the exercise theories and exercise apparatuses may be part of the problem.

Almost all of the existing low back exercises and exercise equipment tend to ignore the fact that the human low back has a natural concave (inward) curve. If this curve becomes exaggerated such as being too concave (often referred to as a swayback condition) or too convex (outward) then low back muscle related soreness, numbness, and/or pain are usually not far behind.

Problems due to the low back curve being too convex are only occasionally encountered. The majority of the suffering populace have the problem of being too concave. This invention addresses the much more frequent problem of low back problems involving the low back curve being too concave.

BACKGROUND

The Problem versus the Proposed Solution

A brief comparison of the current methods and the proposed solution should help to give a better understanding of the different approaches to the problems and to the uniqueness of the solution offered by the invention.

1. Analogy:—A playground see-saw (teeter totter) consists of a long board balanced over a pipe. The center point of the board is attached to the pipe. While being used, a child sitting at each end, the areas of the board in and near the center are subjected to a lot of strain creating a stress force which results in a strained bending of the board. If the force becomes too strong the board may crack or snap at or near the center.

2. In the supine position, the human buttocks extend out under the body and create a see-saw 'pipe' effect This happens because the mass of the bones and flesh of the buttocks form an inverted arch which tends to act as a 'pipe' or point of support that suspends the upper legs and low back in a 'see-saw' manner.

3. Exercise equipment and exercise routines that place the body in a supine position where the person's knees are aimed at an angle that is 90–180 degrees toward the feet create the see-saw effect and increase the upward pressure into the human low back curve. This position partially relaxes the muscles in the low back and may feel good. However, the relief is strictly palliative as the see-saw position caused by the inverted arch of the buttocks may cause an increase in the damaging anterior (towards the front of the body) pressure into the contracted muscle tissues of the low back curve.

Reputable exercise programs warn people against lying on their backs with their legs extended. The supine position is well recognized for its potential to create a detrimental concave pressure into the low back curve, aggravating existing low back problems and possibly causing new low back problems. Exercisers are warned to bend their knees or to place a large pillow under their knees to relieve some of the pressure on the low back curve.

4. Exercises that place the body in a supine position where the person's knees are aimed at an angle that is 0 to 89 degrees toward the head tend to straighten out the low back curve and reduce the anterior force going into the low back curve. However, active low back exercising is virtually ineffective for low back muscle tissue stretching as active exercising requires muscle tension and tends to create muscle resistance to the stretching of the muscle tissues in the low back area. Additionally, with very few exceptions, active stretching cannot be sustained for more than a few minutes or seconds. It is normally especially difficult or uncomfortable for obese people and for pregnant women.

5. The Low Back Stretching Sleeper invention provides an effective method for inactivating the low back curve muscle resistance creating a longitudinal-convex stretching and repetitive gentle exercising of the muscles of the low back.

BACKGROUND

Muscle Tissue Damage

Excess muscle tightness and/or muscle imbalances in the low back area can be very painful.

Following a muscle strain, the muscles tighten up, to attempt to reduce the damaged tissue pressures on the nerves, this defensive mode being a protective function of the muscles. Quickly or gradually, the muscles start to tire and then muscle spasms develop. The muscle spasms may exhibit various levels of discomfort from mild tightness to excruciating pain. These muscle distress symptoms may be temporarily relieved but long term relief will normally not be achieved until proper actions are taken to stretch out the contracted/strained low back muscle(s).

2. The muscles may become painfully inflamed. Inflammation is a healing effort by the body. Patients are sometimes advised, after certain medical procedures, not to use ice or anti-inflammatory substances as the inflammation reaction is a desirable part of the healing process. Occasionally the inflammation gets out of control and the affected area becomes painfully swelled and hot.

Low Back Exercises

There is a bounty of exercise devices to contract, stretch and otherwise work the abdominal muscles, however, there has been no effective exercise apparatus to relax and maximally stretch the muscles of the opposite side of the body, specifically the low back curve. The Low Back Stretching Sleeper provides this capability. The invention takes the business of stretching the low back muscles into a new dimension. It's not enough to stop the muscles from contracting and to be stretched in the normal way—the low back muscles need a way to be inactivated and maximally stretched in a longitudinal-convex direction.

Exercise apparatuses, in general, address the strengthening and flexibility of the muscle structures. The invention addresses the problem of tight low back muscles that are in a swayback-concave state. As many people have discovered, the more they exercise their low backs in the conventional way, the worse the swayback condition becomes. The muscle contractions keep bending the low back more concave.

Relaxed Muscles versus Inactive Muscles

The term relaxed is not specific enough in describing certain body functions. For example, relaxing in a rocking chair while watching a beautiful sunset is a lot different than relaxing while in a coma. In the first case the leg muscles are slowly pumping to achieve a rocking action. In the second case the person's legs are totally inactive.

Longitudinal-convex Stretching of the Low Back Curve Muscles

To achieve the state where there is a longitudinal-convex stretching of their low back muscles the person's body must be in the supine position with their knees bent and facing in a zero to eighty-nine degree angle towards over their head. It also requires their low back muscles be totally relaxed in that low back stretching sleeper position for 15 to 90 seconds or more to allow time for the brain signals to allow the inactivation of the tension or resistance of the low back curve muscles so that said muscles can be maximally stretched.

Muscles

The purpose of skeletal muscles is to contract thereby moving bones such as the bones of the arms. Some researchers claim the muscles also stretch, however, other researchers consider the muscle stretching action as merely relaxation of the contraction and not a true stretch.

Muscle Spindles and Organ of Golgi Fibers

The normal muscle spindle and golgi fiber action is to control the nerve innervation of opposing muscle groups, for example the upper arm biceps and triceps, so they alternate and don't work at the same time. When the biceps are contracted, the triceps relax. When the triceps are contracted, the biceps relax. The antagonistic muscle groups normally alternate, one group contracts while the opposite group stretches and gets a new supply of cleansing blood.

The golgi fibers and muscle spindle fibers are under the control of the brain and in some situations both of the antagonistic muscle groups will retain a certain amount of contraction at the same time. In certain exercises, such as a person using the Atwood (U.S. Pat. No. 6,203, 796) apparatus to perform exercise 20, parts A and B, both the abdominal and low back groups of muscles must retain a certain amount of contraction or else the person and the apparatus would fall down.

Swayback Problem

Most people gradually develop a concavity of the low back curve, a swayback, that is the normal source of a lot of low back muscle discomfort.

1. When a person's low back muscles are actively engaged their low back muscles become contracted thereby becoming shortened and bending the low back curve in a concave direction. The opposite action to this swayback-concave bending of the low back curve is to use an apparatus, the invention, to facilitate the stretching of those muscles in a longitudinal-convex direction.

2. When a person is relaxed, that is, not actively using their low back muscles, the low back curve normally remains semi-contracted and the low back curve is being bent in a concave direction but not as intensely as when said muscles are fully contracted.

3. When inactive in the zero to eighty-nine degree position the low back muscles gradually become stretched out thereby becoming longer and gradually bending the low back curve from the concave condition to a convex condition. The low back muscles remain semi-contracted until they have been moved into the zero to eighty-nine degree angle and have been there long enough, normally 15 to 90 seconds or more, to allow the low back muscle resistance to be deactivated. That's when the low back curve starts bending in a convex direction and the user gets the low back stretching sleeper effect.

4. The convex effect is only achieved when the person's low back curve muscles are relaxed and inactive in a zero to eighty-nine degree position. The low back muscles will always remain shortened and somewhat tensed when the person's body is in the 90 to 180 degree position. Due to the see-saw effect on the low back curve, the muscles normally cannot relax and stretch in that position.

Contraction of Muscles

As the low back muscles contract they pull the low back structures into a swayback concave curve, usually an undesirable condition. Contraction of the low back muscles almost always causes the low back curve to be bent forward, that is, in a concave direction. The contraction action of the low back muscles must be overcome—the low back muscles must be relaxed and relatively inactive otherwise there is no possibility of creating a longitudinal-convex stretching of those muscles.

Requirements to Allow the Muscles of the Low Back Curve to Stretch in a Longitudinal-convex Direction There are three requirements before the low back muscle resistance will be inactivated allowing the muscles of the low back curve to be stretched in a longitudinal-convex direction.

1. The user assumes the low back stretching sleeper position. The lower parts of the user's legs are automatically supported by the invention leaving the user's legs relaxed and totally inactive. The invention's low back stretching sleeper position automatically places the user's body in the body posture necessary for achieving a longitudinal-convex stretching of the low back curve. That position requires the user's knees be pointed at an angle of zero to eighty-nine degrees towards over their head.

2. Relax in the low back stretching sleeper position.

3. Allow enough time to let the brain impulses inactivate the muscle resistance to maximum stretching. This normally takes 15 to 90 seconds or more depending on the tightness of the user's low back muscles. Normally the low back muscles will gradually advance from passively relaxed to passively inactive whereby said muscles are maximally stretched in a longitudinal-convex direction. This is not a normal way of stretching the low back curve. The normal exercise routines result in the low back muscles being kept in a semi-contracted and concave condition.

The low back muscles must be totally relaxed for 15 to 90 seconds or more before the muscles will inactivate and allow a longitudinal-convex stretching. It's not enough to just relax the low back muscles as they will, at first, strongly resist the unaccustomed longitudinal-convex direction stretching. The muscle resistance must be minimized or else the low back muscles will remain semi-contracted and in a concave state. Any low back exercise where the person is transiently in the zero to eighty-nine degree angle for a few seconds does not provide adequate muscle relaxation for enough time, 15 to 90 seconds or more, for the brain directed nerve and chemical processes to inactivate the muscle resistance allowing the low back curve muscles to be stretched in a longitudinal-convex direction.

Accomplishments of the Invention Are

1. Places the user's knees in a zero to eighty-nine degree angle towards over their head which creates the potential for a longitudinal-convex stretching of the muscles of the low back curve.

2. Promotes brain directed nerve and chemical process inhibition of the golgi fiber and muscle spindle activity resulting in a gradual inactivation of the muscles of the low back curve allowing said muscles to be maximally stretched in a longitudinal-convex direction.

3. The body of a person in the low back stretching sleeper position is totally supported and inactive thereby allowing plenty of time, 15 to 90 seconds or more for the brain signals to inactivate the low back muscle resistance to being maximally stretched. The user's brain has control and, with said user in the low back stretching sleeper position, signals their low back muscles to relax. Stretching the low back curve in this manner is not a natural action and must be learned. In every test case, the user could not relax their low back muscles until they had been in the low back sleeper position for at least 15 to 90 seconds. A few people took several minutes in the sleeper position before they could get their low back muscles to inactivate the resistance and start stretching. Then the real stretching effect in a longitudinal-convex direction can start to take place. This maximum stretching position should be maintained for five to ten minutes (+ or −) as enjoyed or tolerated.

4. The user is in control of the invention thereby controlling the amount of stretching that is comfortable and effective for them. Additionally, the invention assures the user that they are in control and their back will not be injured by an exercise such as being bent into the possibly damaging 90 to 180 degree position.

5. More fully stretch out the low back curve muscles to take the pressure off them and allow the re-energizing blood to flow more freely in and out of the muscles.

Active Exercise versus Inactive Exercise

Low back exercise routines normally involve repetitions of contractions and stretches of the low back muscles. Exercising by inactivating the muscles is not an obvious or normal function of exercise. It is a novel approach. Low back muscle tension is epidemic and most people will find their low back muscles are almost always tight even when they are trying to sleep. The muscles stay in this semi-contracted concave position even while the person is sleeping primarily due to the see-saw effect while they lie on their back. Low back muscles often stay in a contracted or semi-contracted condition. Low back muscles need a way to be stretched while in an inactive state so as to avoid the powerful resistance of contracted or semi-contracted muscles. The invention is a novel approach to this problem. The user can totally relax and possibly fall asleep while using the invention.

The Invention Facilitates the Stretching of the Low Back Muscles

The invention is not doing the actual low back stretching work, it is resting the user in an inactive position that inactivates the normal low back muscle contraction response and facilitates the stretching of the low back curve in a longitudinal-convex direction. The invention does not, in itself, do the stretching.

The Key

The key to the invention is its ability to inactivate the low back curve muscle resistance which, after the user assumes the low back stretching sleeper position, usually takes 15 to 90 seconds or more to achieve. This time lag is due to having to wait until the brain impulses direct said muscles to inactivate their resistance to longitudinal-convex stretching.

Unique Accomplishments

The direction and angle of the forces that are created into the tissues of the low back curve which facilitates an inactivation of the low back muscle resistance, resulting in a longitudinal-convex stretching of the low back curve, are of paramount importance and are the primary unique accomplishments of the invention.

BACKGROUND

Specific Problems Involved in Prior Art

Prior art falls into five general categories:

Lumbar supports
Low Back Traction
Ice packs
Heat packs
Exercise equipment:

Lumbar Supports

Lumbar supports (pillows placed or installed in the low back position of chairs and of seats in vehicles) normally exert a relaxing effect on the low back muscles. It does this by pushing the low back muscles anterior and further exaggerating the anterior curve.

Some people, primarily people with a more convex (outward) lower back curve, may find the lumbar supports to be palliatively helpful in reducing low back discomfort.

For the majority of the population, this muscle relaxing effect may feel good but it is usually an impending disaster. Relaxing the aching muscles sounds good in theory, however, its practical value and safety is very questionable.

In real life, some normal low back muscle tension is a necessary part of the waistline muscle structure system, the girdle of muscles surrounding the waistline that help to support the body, give it normal movement, and help to keep the body upright.

Generally, people with a more concave (anterior) curve of the low back cannot sit for long periods of time or drive long distances when they have a lumbar support in their seat. They start experiencing pain/discomfort because the muscles are pushed too far forward and are not in the proper alignment to help absorb the normal shocks to the low back curve.

Low Back Traction

Low back traction devices, often referred to as torture racks, have pretty much fallen into disfavor and disuse due to the pain they often inflict on the already suffering patient. Ties or ropes are attached to the patient at the legs/feet and at the upper body. Then the unit stretches the patient lengthwise to attempt to relieve pressure/pain in the tissues of the low back area.

The basic problem with low back traction is that, in pulling in a direct line force from the head towards the feet, the hips react in a teeter totter (see-saw) fashion and the low back is forced into a more concave curve. This bends the low back curve more anterior instead of stretching out the curve. This often puts additional pressure on the low back curve muscles. Low back traction often causes more pressure and problems instead of relieving the problems.

The likelihood of low back traction creating further injury may be significant in cases where there are partially separated muscle tissue fibers. If too much stretching force is applied, the force may pull the partially separated fibers completely loose therefore requiring surgical repair.

Additionally, the traction devices are usually controlled by an operator other than the patient and that operator often has no real idea of the patient's level of pain.

In summary, due to the see-saw reaction of the hips, the low back traction devices, lack the ability to stretch out the low back at an angle that would specifically stretch out a low back concave curve. The low back traction devices usually apply pressure at a wrong angle for stretching out the low back thereby creating the see-saw effect and often have just the opposite effect. The pressure exerted by the low back traction devices usually buckle and/or contract the muscle tissues in the low back area.

Ice Packs

Ice packs occasionally are effective in helping to relieve some of the symptoms, primarily painful swelling, associated with excessive inflammation.

Heat packs

Heat packs may be appropriate in treating cases of muscle stiffness, soreness or pain due to overwork or overstretching of the muscles.

Heat packs may help to relax the muscle spasms or muscle tightness associated with a concave low back condition. However, the use of heat to relax low back muscle spasms is always a questionable practice.

Heat packs are normally contraindicated when there is inflammation as the heat packs may increase the heat and swelling of the tissues.

Relaxing low back muscle spasms often results in more pain for the patient.

Exercise Equipment

Observing the usually futile exercise methods to work the low backs of people into a healthy condition brings the realization that there was something inherently flawed in the philosophy of existing exercise routines and exercise equipment in how they relate to the low back curve.

In an average human being the low back has a normal concave curve. As this curve becomes exaggerated, normally by swaying forward as a result of injury, aging or lack of activity, discomfort or outright pain problems may arise.

Efforts to strengthen the low back curve usually result in more problems. Many items of exercise equipment proudly announce the creation of a 'power curve,' an extreme swayback movement, into the low back area. This power curve, while impressive looking, is the normal reason the equipment creates low back related problems. The power curve movement bends the concave muscles more anterior. The result is that the exerciser frequently ends up with more discomfort or outright pain and the exercise unit ends up in a closet or in a garage sale.

The function of muscles is to contract. Exercising the low back in any position other than with the knees being in the zero to eighty-nine degree position results in the low back muscles acting like a bow and arrow. The tighter the strings (muscles) contract, the more the bow (low back curve) bends concave. For this reason, the 90 to 180 degree knee position that helps to create the bow and arrow effect should always be avoided even if the exerciser has a strong and perfectly healthy back.

The bow and arrow swayback-stressed low back effect occurs regardless of whether or not the person is using their low back muscles. Whether active or passive, it comes about as a result of being in a bad (90–180 degree knee angle) low back physical position.

The Sleeper was invented to deal with this real need. It recognizes and prevents the problems of placing a person in a position where their body is moved into the destructive 90–180 degree knee position, that is, the bow and arrow swayback-stressing effect on their low back. The Sleeper is a safe and effective exercise unit that provides the user with a means to assure that they exercise in the zero to eighty-nine degree knee position. This is ensured by the use of the Anti-tilt braces, FIG. 6, Drawing Reference Number 26, which prevent their low back curve from moving into the 90–180 degree knee position. There is currently no item of exercise equipment that accomplishes what the Sleeper does almost effortlessly.

Exercise equipment, in general, addresses the strengthening and flexibility of the muscle structures. Normally, little or no concern is given to the possible existence of a concave low back condition which is often the real reason for the low back related soreness, pain and/or numbness. In fact, apparently little or no thought is given to the effect of exercises on the muscle tissues of the low back curve whether they are healthy or unhealthy.

The function of muscles is contraction. Improperly strengthening muscles that are in low back concave curve will tend to bend the contracted muscles of the low back curve further anterior which is usually not desirable and often results in a very painful outcome.

Some passive exercises, such as lying with the feet up on a couch in the 90–180 degree position may partially relax the low back muscles but may also create the possibly damaging see-saw effect into the low back curve. The action may feel good to the muscles but may be perpetuating or increasing the excessive concave curve muscle damage problems that are causing the discomfort.

Prior Art

Atwood patent U.S. Pat. No. 6,203,473

General

As stated in the Atwood specifications column 3 line 53, "the difference in position between a productive stretch and a damaging one becomes only a few degrees of joint angle."

Almost all reputable exercise programs warn people against lying on their backs with their legs extended. The supine position is well recognized for its potential to create a detrimental concave pressure into the low back curve, aggravating existing low back problems and possibly causing new low back problems. Exercisers are warned to bend their knees or to place a large pillow under their knees to relieve some of the pressure on the low back curve. The logic behind this, the seesaw concave effect on the low back curve, is described earlier in the specifications.

Concept

Atwood is totally active allowing no opportunity for passive exercise.

Atwood emphasizes active movements and stretching which always uses contractions of muscles to provide the action. In most exercises, Atwood uses alternating abdominal and low back muscle contractions to achieve and hold the Atwood positions including exercise 20A. The human brain, anticipating further movement, keeps both groups of alternating muscles poised in a state of readiness. In exercises involving the low back muscles, the muscles retain some of the contractions and keep the low back curve in a concave state.

Swayback-Concave Low Back Curve

Atwood FIG. 28 describes an exercise routine where the person has their left knee at an angle less than 90 degrees, however, the right leg is in an extended position which would move the right side of the low back concave into the detrimental bow and arrow swayback-stressed low back condition. Having either or both legs extended violates the low back seesaw concept detailed earlier.

Atwood FIG. 29 shows an exercise where the person has both knees in the 90–180 degree position from the horizontal, one leg extended and one knee at about a 150 degree angle. In this case, there is a real potential to exert a lot of concave pressure into the low back curve resulting in a detrimental low back swayback-stressed condition.

Atwood FIGS. 28, 29, 30, 31A, 31B, 41 and 45 violate the bow and arrow swayback-stressed low back principle with the potential for creating more low back related problems. By having the body in a supine position with the legs in a 90 to 180 degree angle, the seesaw effect described earlier is created. This is definitely contraindicated in low back exercises and in exercise equipment design and use.

Atwood FIGS. 28 and 29. While allowing the user's knees to go into an angle less that 90 degrees from the horizontal, the Atwood unit does not, very importantly, prevent the knees from going into the destructive 90–180 degree bow and arrow swayback-stressed low back position. Having the knees in a 90–180 degree angle creates a concave stretching of the low back muscles. For most people this is a negative stretch leading to back problems from a swayback-stressed low back curve.

Except for an occasional transient move into the zero to eighty-nine degree angle, the Atwood exercises involving supine or semi-supine positions have the user exercising in the 90–180 degree knee position resulting in the effect that the user's low back is curved concave into the detrimental bow and arrow swayback-stressed low back condition. This concave curving result is an anterior (towards the front) stretching which is almost always an undesirable effect.

Passive/Inactive

Passive, by dictionary definition and in the sense used in the specifications, means: In a state of rest or quiescence, not vitally active, without any effort on the part of the user.

Atwood FIGS. 28-29 show the user partly in the supine (on the back) position which is not necessarily a passive position. The actual supine position, with the person lying on their back with their face and palms facing up, is a relatively passive position. The poses shown in the Atwood exercises are not passive.

Atwood FIGS. 28 and 29 are active exercises in which the person is moving about while actively holding onto the handgrips. If the person became passive while using the Atwood device they would relax their grip on the handgrips and they and the unit would probably topple over.

The more inactive the low back muscles of the user are the better the stretch response. Active attempts are usually very difficult, such as described earlier, and normally result in little or no positive low back stretching effects.

The low back muscles must be inactive for 15 to 90 seconds or more to allow for longitudinal-convex stretching of the low back curve.

The Atwood low-effort is not passive. Straddling the Atwood device to try to rest the user's calves on crosspiece 16 or 18 would take considerable effort and could result in the device falling rearward and possibly causing a strain or sprain to the back of the user's knees (popliteal area.), the abdominal area or the low back area.

The Atwood is not designed for nor is it adaptable to passive exercising of the low back curve muscles.

Rocking

The Atwood unit rocks forward and backwards in a head to toe direction of the body. Upon entering the detrimental 90–180 degree knee angle, the arch in the low back is normally greatly exaggerated concave and may create or aggravate a destructive bow and arrow swayback-stressed low back condition.

The Atwood perpendicular rocking creates a concave swaying of the low back curve. Swaying the low back in and out of the 90–180 degree bow and arrow position is very destructive in most cases and should be restrained. Atwood does not have the structure to prevent this undesirable movement.

The Atwood unit rocks in the perpendicular plane which, entering the 90–180 degree position, creates the undesirable seesaw (swayback stressed) effect into the low back and may cause or aggravate low back muscle damage.

Lower Body Support

The Atwood structure does not provide any lower body support other than the floor. The Atwood has no support for the lower body and no structure to prevent the user's knees from falling to the sides of the unit. To allow maximum stretching of the low back curve requires the person's lower body parts be totally relaxed. This is necessary to give the low back muscles time, as stated earlier in the specifications, usually 15 to 90 seconds or more, for the brain to allow the low back muscles to really relax. This requires overcoming the low back normal muscle response and telling the muscles that they are doing something different, that is, stretching instead of contracting. The muscles are going to become inactive. The natural muscle response is contraction but maximum low back muscle stretching is not natural. The brain must direct the low back muscles to stop their resistance and to allow the stretching of the low back curve in a longitudinal-convex direction.

The Atwood unit has only minimum support requiring almost constant physical muscle action to avoid having the unit topple over. The Atwood unit is definitely not suitable for passive exercise as the user must continue to be actively wrestling with the device. The Atwood device does not provide any passive support of the lower body parts therefore the user must remain physically active at all times.

Side to Side Support

A person using the Atwood device would really have to work to keep the device in an upright position. With Atwood the person would always have to maintain muscle control to prevent having their legs slide off to the sides of the device.

Stretching

Atwood column 15 line 26 claims that the FIG. 28 position can be used to stretch the lower back muscles. The stretch shown in FIG. 28 does result in some stretching of the low back muscles on one side of the body at a time, in this case the left side of the body. The position, however, curves the right side of the low back spinal column concave resulting in the bow and arrow swayback-stressed low back condition that must be avoided. When alternating with the right knee bent and the left leg outstretched the position curves the left side of the low back spinal column concave resulting in the bow and arrow swayback-stressed low back condition that must be avoided.

Atwood Exercise Position 20A

Atwood exercise position 20A is the only position where the person's knees, while not intentional and only for a few seconds, are in the non-harmful zero to eighty-nine degree angle towards over their head. This few seconds are while the user attempts to assume an inverted shoulder stand pose as shown in 20B, a very physically demanding and definitely not passive position. Position 20A is only a transient position on the way to an inverted shoulder stand, is very physically demanding, and can only be maintained for a very short period of time which is not enough to have a significant positive effect. As described earlier, active low back exercise in supine positions cannot normally be held for more than a few minutes or seconds and has very limited potential for creating a curved longitudinal posterior (convex) stretching of the muscles of the low back area. The Atwood 20A transient position is an ineffective variation on this difficult-to-hold position.

Performing the exercise in FIG. 20A would result in the tightening of both the abdominal muscles and the low back muscles to maintain this position. In that case the muscles of the low back curve are active and contracting concave. They must be relaxed and inactive for 15 to 90 seconds or more for the low back curve muscles to stretch in a longitudinal-convex direction.

There is no relaxation of the low back muscles in performing exercise 20A—in fact, relaxation of the low back muscles would result in the user falling down.

The stress of maintaining this position, however, makes it unsuitable for stretching the low back curve in a convex direction. Any muscle tension in the low back curve area will bend the curve concave.

The user is definitely not in a passive position. The user is in a semi-supine position, grasping the handgrips and placing the ball of one foot on the lower crosspiece (18). The other leg is lifted and the heel is placed in contact with the forward surface of the top crosspiece (16).

Lower crosspiece (18)

Column 6 line 63 states the "lower crosspiece 18. . . is attached to their "rear" sides, i.e., the sides opposite the sides to which the handgrips 20a, 20b are attached."

Column 7 line 1 states "the lower crosspiece 18 extends "rearwardly" from the legs 11a, 11b by about six inches."

Column 5 line 46 states that "crosspiece 18. . . located between the second ends and the handgrips." This places crosspiece 18 high up on the rearward side of the Atwood device.

Column 6 line 55 states "The range of adjustment for the lower crosspiece 18 along the legs 11a, 11b is between roughly four inches away from the second ends of the legs 11a, 11b and the handgrips 20a, 20b, for a total distance of about eight inches."

The 8 inch limit in range from the top of the second legs would require that crosspiece 18 be at a very high level on the Atwood device.

The high-up location of crosspiece 18 and also having crosspiece 18 extended about six inches rearward of the device creates a real problem with the center of balance. Any weight, such as the weight of the ankles of a person, applied to crosspiece 18 would have to be strongly resisted to prevent the Atwood device from toppling over rearwardly. The user would have to actively support the Atwood device whereas the device should support the user.

Top crosspiece (16)

Crosspiece 16 is located on top of the Atwood device and is far too high up to rest any part of the lower extremities. As shown in Atwood FIGS. 1, 14 and 45, the user can make only slight contact with crosspiece 16. This contact leaves no possibility of the user being able to lie in a passive position. Attempting to use crosspiece 16 for passive exercise could create or aggravate problems (strains or sprains) in the area behind the knee (popliteal area). The user must be very active to achieve and hold these positions. Then the stress of those actions contract the muscles in the low back thereby causing the bow and arrow effect and aggravating the swayback-stressed problems.

The Atwood device does not provide any opportunity for the user to really relax and rest passively as is needed to inactive the low back muscle resistance to stretching. The Atwood user cannot really let go and relax, the Atwood unit would topple over. It would require constant effort to place any part of the lower leg, especially the calves, onto crosspiece 16 or 18 and especially to attain any degree of comfort and relaxation. Crosspiece 18 is located on the rearward side of the unit between the second legs and the hand grips and six inches away from the center of balance. This location puts this item up too far to be of any value where the position requires a passive relaxation of the lower legs so as to allow a convex stretching, not concave contractions, of the low back tissues.

Adjustments

The adjustments and setting of crosspieces 16 and 18, as detailed in column 9 lines 9–37 are of no value to a person desiring to stretch out the muscles of the their low back curve. The adjustable parts of the Atwood device, crosspieces 16 and 18, are very high up in the device and are not suitable for easy reach or passive exercise.

Structure

Low back exercises using the Atwood device, due to the device's structure, cannot result in a longitudinal-convex (posterior) stretching of the low back muscles. Atwood lacks the structure to facilitate inactive stretching of the low back curve muscles. Atwood is an active concept and has neither the structure nor the exercise philosophy to facilitate low back longitudinal-convex stretching or the overcoming of the nerve and chemical brain directions to allow relaxation of the low back muscles. Atwood has neither the structure or function(s) to bend the low back curve in a convex direction.

Attempting to use the Atwood apparatus for other than its intended active exercise purposes could result in serious spinal damage including hyperextension of the spinal column.

The Physically Challenged

The Atwood device would not normally be usable by a physically challenged person as the person would probably require almost constant assistance from an attending person to keep the Atwood unit from toppling over.

Potential for new damage or aggravation of existing low back problems.

Lying in the supine or partly supine positions using the Atwood device allows the low back to rock or move into the 90–180 degree knee position. This is a totally undesirable and potentially injurious low back position and is definitely contraindicated for use by most people and especially those who have low back related problems. Exercise activities resulting in the 90–180 degree swayback position should be restrained.

BACKGROUND

Summary

Any apparatus or exercise that moves or forces the low back curve anterior or creates the see-saw effect in the low back curve may have a damaging effect on a concave low back condition.

The direction and angle of the forces that are created into the muscle tissues of the low back curve are of paramount importance.

BRIEF SUMMARY OF THE INVENTION

Description

The Low Back Stretching Sleeper provides a passive exercise support unit whereby a person can gently stretch out their low back muscles without subjecting themselves to additional problems. The see-saw effect caused by the inverted arch of the buttocks is eliminated as well as most or all of the low back muscle tension and resistance to stretching of the low back muscle tissues.

Operation

The person lies on their back, pulls their knees up to a knee-chest position, and then places the calves of their legs up on top of the deck of the unit.

The slant of the unit is adjusted to the most desirable and comfortable position wherein the person's knees are pointed at an angle, 0 to 89 degrees, towards over the person's head. This puts the person in a body position wherein a curved longitudinal posterior stretch is thereby created into the muscles of the low back area.

Then just the normal action of breathing does the stretching as the relaxed position and the greatly minimized resistance of the low back muscles allow a gently curving longitudinal posterior stretching of the muscles of the lumbar, lumbosacral, and sacroiliac areas.

If desired, the person can rock their knees lightly from side to side to impart a mild twisting motion to the spinal area. This has the added benefit of stretching out the low back muscle fibers in a rotational manner.

The person lies in this position for five to ten minutes (+ or −) as enjoyed or tolerated.

Objects and Advantages

Several objects and advantages of the Low Back Stretching Sleeper are:

1. The sleeper is a simple device designed to gently stretch and strengthen the low back muscles while helping to relieve low back muscle related tightness and soreness.
2. The sleeper places the person in the precisely correct position so that their normal breathing actions will gently stretch out anteriorly buckled/contracted muscle fibers in the lumbar, lumbosacral, and sacroiliac areas.
3. The sleeper correctly addresses the frequent problem of low back muscle problems involving the low back curve being too concave.
4. The sleeper temporarily changes the position of the hips thereby minimizing or eliminating the see-saw effect on the low back curve.
5. The sleeper assures effective but extremely safe posterior stretching of the lumbar, lumbosacral, and sacroiliac areas. This results in a subtle but definite stabilization of the muscles of the low back area.
6. The position that is achieved with the patient using the sleeper results in a curved longitudinal-convex stretching of the low back muscles.
7. The sleeper places control of the unit in the hands of the user. There is no fear of being hurt by being suddenly or roughly moved or overstretched.
8. A major concern with exercise routines and exercise equipment is the impact they have on the body; the harder it is on the body the higher the impact rating. The sleeper would be rated at Very Low Impact, just above the impact of normal breathing.
9. The very slight physical effort and very low impact effect make the sleeper ideal for people of all ages including people who are physically challenged. This makes the invention ideal for people who can't exercise, have too much muscle soreness or tightness to exercise, or don't like to exercise.
10. Being primarily passive in nature, the sleeper does not require the user to have any physical agility, strength, or stamina. Even partially paralyzed people should normally be able to benefit from the low back muscle stretching effect of the invention.
11. The sleeper is virtually passive for the user. In fact, the word 'sleeper' in the title was derived from the fact that people using the prototype could fall asleep in the assumed position and still receive the full benefits of the exercise.
12. The primarily passive nature of the sleeper encourages total relaxation of the low back muscles thereby removing much muscle resistance and allowing a much more effective posterior stretching of the muscles.
13. The sleeper is very portable, being lightweight and compact.
14. The sleeper is simple to set up and use and the simple process can be easily learned in as little as two or three minutes.
15. The sleeper may be adjusted to conform to the body size and other variations of the user, there being a lot of variations such as height, weight, size of abdominal area, flexibility and physical conditioning.
16. The sleeper is versatile. It may be used by both amateurs and exercise professionals.
17. Low back soreness and/or tightness is one of the chief complaints of patients after surgery or accidents. The body area of discomfort specified the most is in the small of the back at the inward curve. The sleeper unit is ideal for use on hospital and nursing home beds to help relieve some of the low back muscle tightness miseries associated with long periods of lying in bed. This is probably due to the see-saw effect created by the inverted arch of the hips balanced on top of a firm mattress. Historically, the idea for the sleeper originated while I was lying in a hospital bed after surgery. The incisions were not comfortable but the worse discomforting was in the small of my low back. I asked a friend to bring me some materials and I created a very rough prototype while lying in bed. Thank God the invention worked and gave me blessed quick relief.
18. The open design of the sleeper enables people with severe low back muscle stiffness to be assisted by another person. The sufferer just has to lie on their back and pull their knees up toward their chest. The assisting person then slides the sleeper up under the sufferer's pulled up lower legs.
19. The sleeper may be constructed of any combination of rigid or semi-rigid materials such as wood, metal, etc.
20. No internal or external power source is needed but power may be added as an optional way to achieve unit or body angle adjustment positioning, and/or movement.

Summary, Ramification, and Scope

Accordingly, the reader will see that the invention goes a long way towards resolving the problem by creating a gentle and safe curved longitudinal posterior stretching of the muscles of the low back structures.

The sleeper helps to relieve low back muscle tension related problems, however, it is not a substitute for proper medical evaluation and treatment of serious low back problems.

The sleeper is ideal for many low back tightness and/or soreness sufferers who have difficulty getting out of bed. The sleeper provides what is possibly the only effective exercise that can be tolerated.

The unit requires no power source, the only source needed being natural breathing by the person using the unit. This makes the unit totally portable and usable anywhere in the world.

The nature of the sleeper is primarily passive therefore a person can continue to receive the positive low back muscle stretching effects even if they fall asleep while using the unit.

The actual relaxation of the low back muscles and the direction and curved longitudinal posterior angle of the forces that are created into the muscle tissues of the low back curve are of paramount importance and are the primary unique accomplishments of the structure of this invention.

Although the description above contains many specificities, these should not be construed as limiting the scope of the invention but as merely providing illustrations of some of the presently preferred embodiments of this invention. For example, the invention may have adaptations such as being preset and/or locked in at a specific slant between 0 and 89 degrees, having an angle control at the center or some other position on the unit, having a mechanical, electrical, or electronic means to adjust or move the unit, etc. The unit can also have other shapes such as circular, oval, trapezoidal, triangular, etc.

Thus the scope of the invention should be determined by the appended claims and their legal equivalents, rather than by the examples given.

BRIEF DESCRIPTION OF THE SEVERAL VIEWS OF THE DRAWINGS

Drawing Figures

Reference Numerals in Drawings

| | |
|---|---|
| 10 - Deck | 12 - Upright support - superior end |
| 14 - Connecting rod | 16 - Upright support - inferior end |
| 18 - Horizontal main frame | 20 - Stabilizing extension |
| 22 - Angle control bar | 24 - Tilt bracket |
| 26 - Anti-tilt brace | 28 - Apertures |

DETAILED DESCRIPTION OF THE INVENTION

A typical embodiment of the Low Back Stretching Sleeper unit is comprised of a:

1. Lower body support unit which places the user into a body position in which a curved longitudinal posterior stretching of the low back muscles is automatically created.
2. An angle setting device as a means for setting the unit at the appropriate 0 to 89 degree slant for the person to passively, gently, and safely stretch out their low back muscles.

Figure 1:
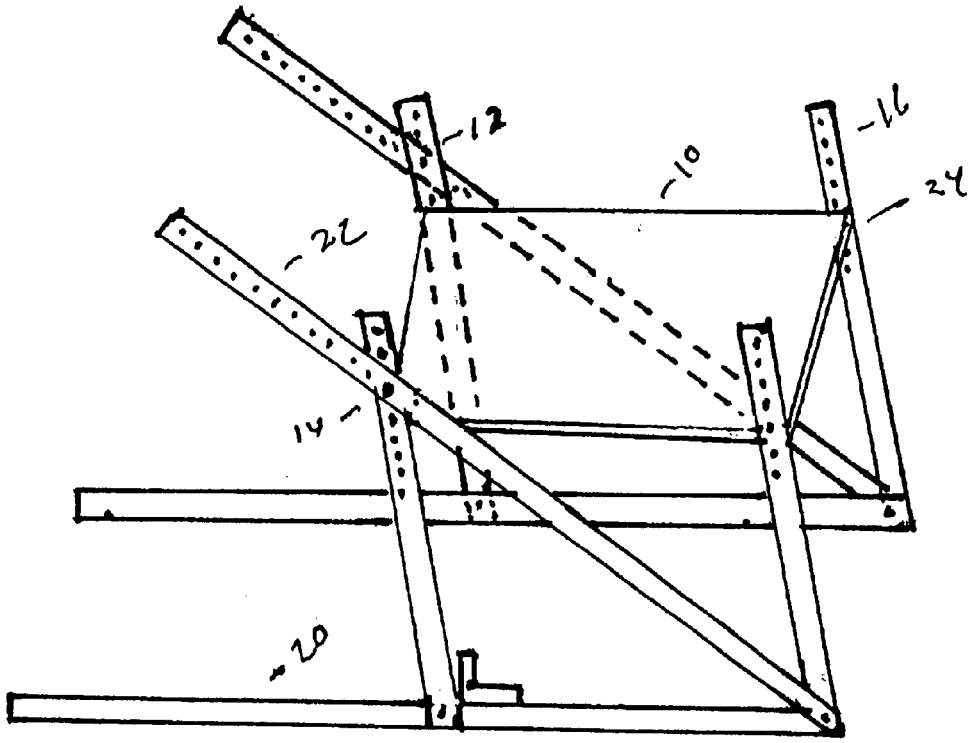
FIG. 1 is a perspective view of the invention according to a typical embodiment of the present invention.
Figure 2:
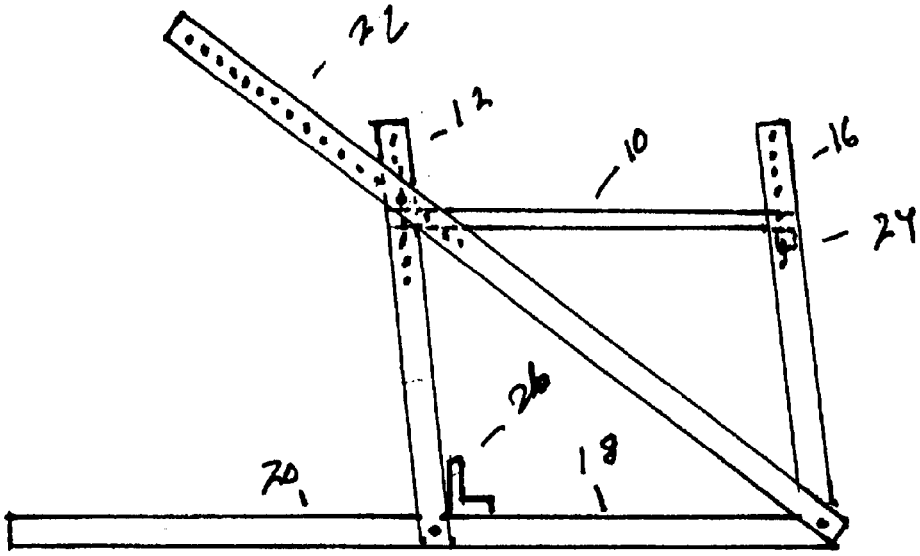
FIG. 2 is a side view, the opposite side being a mirror image.

There are many possible adjustable embodiments such as the one shown in FIG. 1 plus many others which may be temporarily or permanently set at an angle between 0 and 89 degrees.

The embodiment shown in FIG. 1 is approximately 24 inches long by 24 inches wide by 24 inches high and has 24 inch long Stabilizer extensions (20). The Tilt brackets (24) are approximately 2 inches long on the 2 hole side, 1 inch long on the 1 hole side, and ⅝ inch wide. The Anti-tilt braces (26) are approximately 3 inches long where they attach to the Horizontal main frame (18) and 3 inches high by 3 inches wide on the upper portion. Different size units may be appropriate depending on the size and special needs of the user such as for people who are very small, very tall, or very obese.

10—Deck—for lower legs.—The person places the calves of their legs up on the Deck.

12—Upright support—superior (towards the head) end—The Connecting rod (14) on the upper portion of this part couples with the Angle control bar (22) to adjust or set the slant of the unit.

14—Connecting rod—couples Upright support—superior end (12) to the Angle control bar (22)

16—Upright support—inferior (towards the feet) end.

The Upright supports (12) & (16) support the Deck (10) and are attached to the Deck by the Tilt brackets (24). The Uprights also serve to prevent the person's legs from sliding off to the sides of the unit.

18—Horizontal main frame—The Horizontal main frames also serve as runners to easily slide the unit under and out from under the person's lower legs. The portion of the runner extending towards the user's head serves as a Stabilizer extension (20).

20—Stabilizing extension—Part of the Horizontal main frame (18). Prevents potentially pain inducing tilting of the unit towards the person's upper body.

22—Angle control bar—attached to the lower end of the Upright support—inferior end (16) and couples with the Connecting rod (14) to set or adjust the slant of the unit. Embodiments that are permanently preset at an angle of 0 to 89 degrees may not have an Angle control bar.

24—Tilt bracket—A tilt bracket is fastened under each comer of the Deck (10) and attached to the upper part of the Upright supports (12) & (16). Provides the ability for the Deck (10) to remain level while following the angle position set by the Angle control bars (22). The 2 hole portion is attached to the bottom of the Deck (10). The single hole portion is attached at one of the apertures in the Upright supports (12) & (16).

26—Anti-tilt brace—Prevents the unit from shifting into the possibly injurious 90–180 degree angle position wherein a see-saw anterior force is created into the lower back curve. The Anti-tilt braces are attached to the Horizontal main frame runners (18). The Anti-tilt braces are not attached to the Upright supports—superior end (12) but are positioned so that the superior Uprights will bump against the braces if the unit is moved into the 90 degree angle position.

Operation

The Low Back Stretching Sleeper is normally placed on a flat surface, preferably a bed, couch, or exercise type pad.

Using the Upright supports (12) & (16) and Tilt brackets (24), the height of the unit is adjusted to conform to the size of the person who will be using the unit.

The person lies down on their back with their buttocks between the two stabilizing extensions (20) and with their feet aimed towards the Deck (10).

With knees bent, they slide their buttocks under the Deck (10) and place the calves of their legs up on top of the Deck. This automatically places the edge of the Deck into the seams at the back of their bent knees.

The unit is then slid towards the head of the person and, inserting the Connecting rod (14) on each side into one of the apertures in the Angle control bar (22), the angle is adjusted until the person's knees are in a 0 to 89 degree position, as is effective but comfortable, facing over their head. This position helps to assure that a curved longitudinal posterior stretch is created into the muscles of the lumbar, lumbosacral, and sacroiliac areas. This actual relaxation of the muscles and the passive curved longitudinal posterior stretching of the low back muscles are the paramount and most unique advantages of the invention.

The person breathes in and out normally wherein this normal breathing action will create a light stretching action in the low back area.

If desired, the person can swing their knees slowly and lightly from side to side to create a mild twisting motion to the spinal area. This has the added benefit of stretching out muscle fibers in a rotational manner.

The person lies in this position for five to ten minutes (+ or −) as enjoyed or tolerated.

The person then rolls onto their side and carefully gets up from that position.

Prototype

To Build a Prototype (The cost to build the prototype was approximately $ 11.96).

Materials List

| Parts required: | Cost | |
|---|---|---|
| | | All prices shown are retail at local builder supply stores. |
| 4 | $3.43 | 8 foot long 1 × 2's - (Pine) with smooth milled edges.<br>Cost: $0.98 for 8 foot lengths ($0.1225 per foot).<br>28 feet × $0.1225 = $3.43 |
| 1 | $0.35 | 24 inch long 1 × 3 inch board (Pine).<br>Cost $1.38 for 8 foot length ($0.1725 per foot)<br>2 feet × 0.1725 = $.345 |
| 1 | $2.74 | ¼ inch plywood 24 inch × 24 inch.<br>Cost $5.48 for a 24 × 48 section. |
| 4 | $1.77 | 2 inch Corner braces to use as Tilt brackets.<br>Cost: 4 for $1.77. |
| (2) | | Anti-Tilt Brackets - This part does not exist at this time. Substituted Angle 23 produced by Simpson. |
| 1 | $0.44 | Angle A23 - (Home Deck building hardware).<br>Simpson brand (800) 999-5099 -<br>Cost: $0.44 each. |
| | | Bolts to Assemble and Adjust the Sleeper unit: |
| 2 | $0.55 | 3 inch long × ¼ inch -<br>round head stove bolts (or similar).<br>Cost: 3 bolts and lock nuts for $0.82 |
| 2 | $0.55 | 2½ inch long × ¼ inch -<br>round head stove bolts (or similar).<br>Cost: 3 bolts and lock nuts for $0.82. |
| 2 | $0.41 | 2 inch long × ¼ inch -<br>round head stove bolts (or similar). |

-continued

| | | |
|---|---|---|
| | | Cost: 4 bolts and lock nuts for $0.82. |
| 4 | $0.66 | 1½ inch long × ¼ inch -<br>round head stove bolts (or similar).<br>Cost: 5 bolts and lock nuts for $0.82. |
| 6 | $0.79 | Wing nuts - ¼–20<br>Cost: 6 for $0.79. |
| (4) | ($0.22) | Lock nuts - ¼ inch<br>Cost: 12 for $0.67. Did not purchase them as the lock nuts came in the packages with the ¼ inch bolts. |
| 18 | $0.17 | Screws - 1 inch All purpose screws<br>Cost: one pound (approx. 326 screws) for $2.98. |
| 4 | $0.10 | Screws - 2 inch All purpose screws.<br>Cost: one pound (approx. 119 screws) for $2.98. |
| Total | $11.96 | |

Tools needed:

Screwdriver to tighten bolts.
Pliers or wrench to tighten the Lock nuts.
Electric drill
Countersink drill bit(s)
⅛ Inch drill bit
5/16 Inch drill bit.
Awl to make small holes.
Hacksaw (or power metal cutter).
Metal file (or power tool)
Wood file (or power tool)
Sandpaper or power sander

Cutting and Drilling

Cutting of Boards 8 foot 1×2 Inch boards (The actual measurement of 1×2 boards is ¾ inch by 1½ inches).

Cut (cross cut) and mark each piece with a letter as indicated below. Use a pencil or removable sticker and mark the number/letter shown onto the ¾ inch edge of the end of each board. The ends with number/letter markings will be designated as the 'lettered' ends of the boards (for an example see the letter 'A' in FIG. 4). The opposite ends will be referred to as the 'upper' ends.

2–44 inches long to use as Angle control bars (22). Mark them A & H

2–44 inches long to use as Horizontal main frame (18) runners. Mark them C&F 2–26 inches long to use as Upright supports-inferior end (16). Mark them B & G.

2–26 inches long to use as Upright supports-superior end (10). Mark them D&E.

2–24. inches long to use as Deck supports (10A). Mark both boards 10A.

1×3 Inch board 1 piece 24 inches long. Mark with the letter 'I'.

24×24 inch×¼ inch thick plywood. (Deck (10)). Mark the number 10 on the smoothest side of the board.

(See Drawings FIG. 7) Draw a very light line ¾ inch from any edge. Mark three spots along that line; one at 2 inches, one at 12 inches, and the third at 22 inches.

Repeat the process on the opposite end of the board.

Drill 6 holes for #6 1 inch all purpose screws, one at each mark, using a countersink drill bit.

Cutting and Drilling of the Angle A23 and 2 inch Corner Braces

A23 Angle: (Anti-Tilt brace (26). Cut the three inch (2¾ inch) width into 2 equal sections each approximately 1½inches wide.

On both pieces, along the center edge that was cut, drill a ⅛ inch hole directly in line with the existing hole to allow the use of #6 1 inch all-purpose screws for fastening the A23 angle to the Horizontal main frame runner (18).

Use the metal file to smooth off any rough edges.

Figure 5:
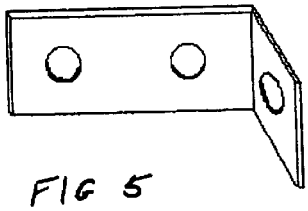
FIG. 5 is a perspective view of a Tilt bracket (24).
Figure 6:
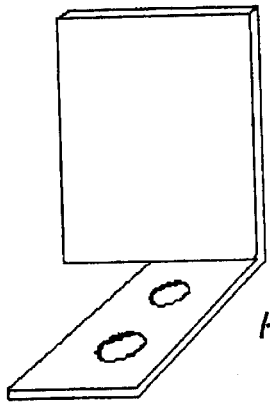
FIG. 6 is a perspective view of an Anti-Tilt brace (26), the opposite side being a mirror image.

Corner braces: (Tilt brackets (24). Cut off one wing of each brace at the middle between the 2 holes in order to conform to the Tilt bracket configuration shown in FIG. 5 of the Drawing Specifications.

Assure the holes in the one wing portion of the Tilt brackets (24) are large enough to allow a ¼ inch bolt to pass through the hole. If necessary, widen the holes using the 5/16 inch drill bit.

Use the metal file to smooth off any rough edges.

Drilling of Holes in the 1×2 Boards

Drill all holes using the 5/16 drill bit unless otherwise specified. All holes are to be centered on the 2 inch side of the boards unless otherwise specified.

Upright supports: boards B, D, E, and G. (see Drawings FIG. 3).

Drill 1 hole ¾ inch from the lettered' end.

Drill 1 hole ¾ inch from the upper end and then at 1 inch intervals for a total of 14 holes at the upper end.

Upright supports-superior end (12): boards D & E.—To insert the Connecting rods (14). (See Drawings FIG. 3).

Drill 1 hole half way between the 2nd and 3rd holes in the upper end.

Upright supports-inferior end: boards B & G. Measure 2 inches and 3 inches from the last (14th) hole. Mark and drill two holes (#15 and 16) using a countersink bit for 2 inch All purpose screws. (see next two sentences). (For attachment of Anti sway Brace-board 'I').

Upright support-inferior end: board B. On the left side, countersink holes 15 & 16 for insertion of 2 inch All purpose screws.

Upright support-inferior end: board G. On the right side, countersink holes 15 & 16 for insertion of 2 inch All purpose screws.

Figure 4:
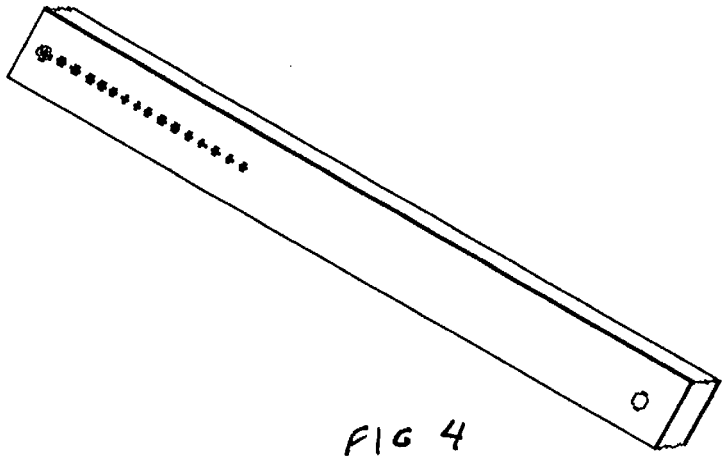
FIG. 4 is a perspective view of an Angle control bar (22)

Angle control bars (22) boards A & H (See Drawings FIG. 4).

Drill 1 hole ¾ inch from the lettered end.

Drill 1 hole ¾ inch from the upper end and then at 1 inch intervals for a total of 12 holes at the upper end.

Horizontal main frame runners (18). boards C & F (See Drawings FIG. 9).

Drill 1 hole ¾ inch from the lettered end.

Drill 1 hole 23¼ inches from the lettered end.

Anti-sway brace—board I: At each end of the board (not the sides), mark and center two holes, one inch apart, to receive the 2 inch All purpose screws from boards B & G. Use an Awl to make the small holes.

Assembling the Sleeper Unit

Remember to always keep the letters on the lettered boards facing towards you where you can see the letters.

Lay the Deck (10) flat with the edges with the pre-drilled holes placed over the top of the two Deck supports (10A). The Deck supports should be flush (even) with the edges of the Deck. Attach using #6×1 inch all purpose screws.

Turn the Deck (10) over and center the Tilt brackets (24) at the very edges of the Deck supports (10A) The two hole wings of the Tilt brackets are fastened to the Deck supports (10A) using #6×1 inch all purpose screws.

Boards C & F. The shorter wing of the Angle 23 is fastened across the upper (¾ inch) edge of the Horizontal Main Frame runner (18), C & F, using #6×1 inch all purpose screws. The corner of the Angle 23 brace should be positioned 22 ½ inches from the lettered end of the runner. The outer edge of the Angle 23 should extend out ¾ inch to the outside. (On board C the angle should extend out to the left side. On board F the angle should extend out the right side). In this position the longer wing of the Angle 23 will make contact with boards D & E, the Upright supports-superior end (12) to prevent pinching of the hands or fingers should the unit move towards the possibly injurious 90–180 degree angle.

Figure 3:
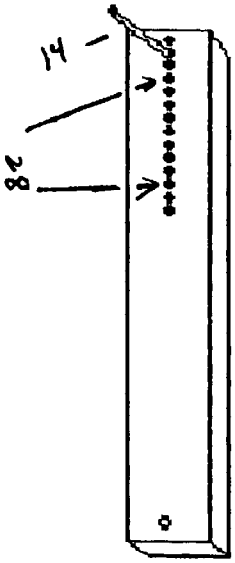
FIG. 3 is a perspective view of an Upright support—superior end (12) showing a Connecting rod (14) to couple with one of the apertures of the Angle control bar (22). The Upright support-inferior end (16) is identical except it does not have a Connecting rod (14).

Board D (See Drawings FIG. 3). (Connecting rod (14). Insert a 2½ inch bolt, from the right side, into the 3rd hole (2¼ inches from the end) in the upper end of the Upright support-superior end (D). The bolt should be inserted so that the bolt is sticking out to the left side of the unit. Fasten with a Lock nut.

Board E. (See Drawings FIG. 3). (Connecting rod (14). Insert a 2½ inch bolt, from the left side, into the 3rd hole (2¼ inches from the end) in upper end of the Upright support-superior end (E). The bolt should be inserted so that the bolt is sticking out to the right side of the unit. Fasten with a Lock nut.

Boards A, B. C. On the board marked 'A', insert a 3 inch bolt from the left side into the hole in the lettered end. Then slip the bolt through the hole in the lettered end of the 'B' board and then the "C' board. The ends of the boards should then line up like the start of the alphabet, A-B-C. Then hand tighten using a Lock nut.

Boards F, G, H. On the board marked 'H', insert a 3 inch bolt from the right side into the hole in the lettered end. Then slip the bolt through the hole in the lettered end of the 'G' board and then the 'F' board. The lettered ends of the boards should then line up alphabetically as F-G-H. Then hand tighten using a Lock nut.

Boards C & D. On board C, in the hole at the 23¼ inch mark (measured from the lettered end), insert a 2 inch bolt from the right side. Slip the lettered end of board D onto the bolt. Fasten with a Lock nut. Make sure the Connecting rod (14) is facing outward towards the left.

Boards E & F. On board F, in the hole at the 23¼ inch mark (measured from the lettered end), insert a 2 inch bolt from the left side. Slip the lettered end of board E onto the bolt. Fasten with a Lock nut (34). Make sure the Connecting rod (14) is facing outward towards the right. Lay the A-B-C & F G-H boards flat so that you can read all of the letters. In this position the Anti-tilt braces (26) on boards C & F are on the top edge of boards C & F.

Place the Deck (10), with Tilt brackets (24) facing downward between the two sets of lettered boards, the A-B-C group and the F-G-H group. The middle of the sides of the Deck (10) should be approximately equal with the Anti-tilt braces (26) on boards C & F.

Stand up board B (Upright support-inferior end) and insert a 1 and ½ inch bolt from the left side into the seventh hole from the top. Then insert the bolt through the nearest (left front) Tilt bracket (24) under the Deck (10). Secure the bolt using a Wing nut.

Stand up board G (Upright support-inferior end) and insert a 1½ inch bolt from the right side into the seventh hole from the top. Then insert the bolt through the nearest Tilt bracket (24) under the Deck (10). Secure the bolt using a Wing nut.

Stand up board D (Upright support-superior end) and insert a 1½ inch bolt from the left side into the seventh open hole (do not count the hole now occupied by the Connecting rod (14)) from the top. Then insert the bolt through the nearest Tilt bracket (24) under the Deck (10). Secure using a Wing nut.Stand up board E (Upright support-superior end) and insert a 1½ inch bolt from the right side into the seventh open hole from the top. Then insert the bolt through the nearest Tilt bracket (24) under the Deck (10). Secure using a Wing nut.

(See Drawings FIG. 11) Stand up board B (Upright support-inferior end) and insert two 2 inch long All purpose screws, from the left side, through holes 15 & 16. Attach to Anti-sway brace—Board I and tighten the screws.

Stand up board G (Upright support-inferior end) and insert two 2 inch long All purpose screws, from the right side, through holes 15 & 16. Attach to Anti-sway brace—Board I and tighten the screws.

Boards A & H. On both sides, slide the 5th hole from the top of the Angle control bar (22) onto the Connecting rods (14) on boards C & D. Secure with Wing nuts.

File or sandpaper any rough edges.

The Sleeper unit is now ready for use.

The height of the Sleeper is set for an average person of about 5 foot 7 in height.

Adjust the height of the unit for taller or shorter people by moving the Tilt brackets up or down on the Uprights (12) & (16).

The angle of the sleeper is adjusted for comfort and effectiveness by moving the Connecting rods (14) into the various holes in the Angle control bars (22).

What I claim as my invention is:

1. A low back stretching exercise apparatus comprising:

a. A deck means for supporting the lower part of the legs of the user thereby allowing the user to lie totally inactive in the low back stretching sleeper position, b. Upright support means for adjusting the height of the deck to the length of the upper part of the legs of the user and to prevent their inactive legs from sliding off to the sides of the deck, c. Angle control means for setting or adjusting the invention to the appropriate slant for the user where their knees are pointed at a zero to eighty-nine degree angle towards over their head, whereby the invention comfortably positions the user's body assuring their knees are passively pointed in a zero to eighty-nine degree angle towards over their head and whereby the muscles of the user's low back curve become relaxed and totally inactive allowing simple breathing actions to stretch said muscles in a longitudinal-convex direction.

2. The low back stretching exercise apparatus of claim 1, which further includes an anti-tilt mechanism means for preventing the user's body from going into the potentially low back damaging 90 to 180 degree angle position, whereby the user can completely relax their low back muscles knowing their low back will not be injured by being bent into the possibly injurious 90–180 degree position.

* * * * *